US006827050B2

(12) United States Patent
Cotton, III et al.

(10) Patent No.: US 6,827,050 B2
(45) Date of Patent: Dec. 7, 2004

(54) FLUID CONTROL VALVE ACTUATING SYSTEM

(75) Inventors: Clifford E. Cotton, III, Pontiac, IL (US); Bernhard Kirsch, Mandelbachtal (DE); David E. Martin, Normal, IL (US); Olaf Ohligschlaeger, Grunebach (DE); Rene Schulz, Burbach (DE); Ronald D. Shinogle, Peoria, IL (US); Alan R. Stockner, Metamora, IL (US); Ye Tian, Bloomington, IL (US); Stephen M. Wiley, Normal, IL (US)

(73) Assignee: Caterpillar Inc, Peoria, IL (US)

( * ) Notice: Subject to any disclaimer, the term of this patent is extended or adjusted under 35 U.S.C. 154(b) by 0 days.

(21) Appl. No.: 10/244,329

(22) Filed: Sep. 16, 2002

(65) Prior Publication Data

US 2003/0116109 A1 Jun. 26, 2003

Related U.S. Application Data

(60) Provisional application No. 60/345,423, filed on Dec. 21, 2001.

(51) Int. Cl.[7] ..... F01L 9/02

(52) U.S. Cl. ..... 123/90.12; 123/90.15; 123/90.31; 251/12

(58) Field of Search ..... 123/90.12, 90.15, 123/90.16, 90.17, 90.27, 90.31; 251/1, 12

(56) References Cited

U.S. PATENT DOCUMENTS 5,299,488 A * 4/1994 Kadlicko et al. ..... 91/363 A
5,501,186 A * 3/1996 Hara et al. ..... 123/90.16
5,579,807 A * 12/1996 Kohler ..... 137/625.65
5,680,841 A * 10/1997 Hu ..... 123/322
5,697,342 A * 12/1997 Anderson et al. ..... 123/446
5,758,499 A * 6/1998 Sugiyama et al. ..... 60/450

* cited by examiner

*Primary Examiner*—Thomas Denion
*Assistant Examiner*—Ching Chang
(74) *Attorney, Agent, or Firm*—Alan J Hickman

(57) ABSTRACT

A control system adapted to control an actuator between extended and retracted positions has a fluid control valve connected to the actuator a source of high pressure fluid and a reservoir. The fluid control valve is movable between a first position at which the actuator is connected back to the fluid reservoir adapted and a second position operable to connect the actuator to a high pressure actuation fluid source. An electronic control module is connected in control communication with the fluid control valve and adapted to automatically generate a control signal to position the control valve at the second position in response to an elapsed time being passed at which the fluid control valve is at the first position is greater than a predetermined time.

5 Claims, 2 Drawing Sheets

FLUID CONTROL VALVE ACTUATING SYSTEM

This application claims the benefit of prior provisional patent application Ser. No. 60/345,423 filed Dec. 21, 2001

TECHNICAL FIELD

The present invention relates to an apparatus and method for controlling a fluid control valve and more particularly to an apparatus and method for periodically actuating a hydraulic control valve of an compression release brake system of an internal combustion engine and reduce silting in the hydraulic control valve.

BACKGROUND

Compression release engine brakes or engine retarders are used to assist and supplement wheel brakes in slowing heavy machines such as earthmoving vehicles, off and on highway trucks, buses and the like. Compression release engine brakes often utilize an actuator that is fluid operated to mechanically move an engine valve at an appropriate timing to achieve compression release braking. Opening an exhaust valve on a compression stroke of the engine at or near top dead center of an engine piston causes the engine cylinder to blow down and exhaust the compressed air in the cylinder to atmosphere. At an appropriate time during the intake stroke of the engine the engine valve is closed. This cycle is repeated over and over again with respect to the each engine cylinder until braking is no longer needed. This allows the engine to develop a retarding horsepower which may be a substantial portion of the operating horsepower developed by the engine in its operating mode.

In some compression release brake systems, an opening and closing of the exhaust valve at the end of the compression stroke may be performed by a hydraulically operated actuator having a piston and a plunger. A control valve having a spool may be provided to controllably connect the hydraulically operated actuator to a source of high pressure fluid, such as a hydraulic rail of a hydraulically actuated fuel system. Each time a compression release event is desired for an engine cylinder, the hydraulic control valve is actuated in order to deliver high pressure hydraulic oil to the actuator which mechanically opens the exhaust valve.

Under normal operating conditions, the control valve is actuated very infrequently, e.g., the control valve may be actuated less than 5% of the engine operating time. Therefore, due to debris in the hydraulic fluid and the presence of the relatively high pressure of the hydraulic fluid, e.g., on the order of 5–31 MPa, at an inlet port of the hydraulic control valve, silting may occur in a sealing clearance between the spool and the body of the control valve at a location adjacent the inlet port of the hydraulic control valve. That is, impurities, such as metallic and non-metallic particles contained in the fluid may be deposited and compacted over time at the inlet port of the control valve. As a result, silting in the control valve may cause the control valve to function improperly by delaying or possibly precluding valve opening.

The occurrence of silting is dependent upon several factors such as valve sealing clearances, debris particle size, the pressure of the hydraulic fluid and the level of debris in the hydraulic fluid. The level of impurities in the fluid may be based upon the source and application of the hydraulic fluid and may increase over time due to the operating environment of the engine. Further, the pressure of the hydraulic fluid generally required to produce silting is on the order of about 7 MPa.

The present invention is directed to overcoming one or more of the problems as set forth above.

SUMMARY OF THE INVENTION

In one aspect of the present invention, a control system has an actuator, a source of high pressure fluid flow, and a fluid reservoir. The actuator has a plunger movable between an extended position and a retracted position. A control valve having a spool movable between a first position and a second position is connected to the actuator, the source of high pressure fluid flow, and the reservoir. The control valve is adapted to deliver fluid flow from the actuator to the reservoir at the first position of said spool and is adapted to deliver high pressure fluid flow from the source to the actuator at the second position of the spool. An electronic control module is connected in control communication with the control valve and is adapted to deliver a control signal to the control valve. The control valve spool is movable to a one of said first and second positions in response to receiving the control signal. The electronic control module automatically delivers the control signal to the control valve in response to a predetermined elapsed time during which the control valve is at the one of the first and second positions being greater than a predetermined time.

In another aspect of the present invention a compression release engine brake system has an engine cylinder, a source of high pressure fluid flow, a fluid reservoir, and an exhaust valve disposed in the engine cylinder and movable between a first position at which fluid flow is blocked from leaving the cylinder and a second position at which fluid flow is passable from the cylinder and an actuator having a plunger movable between extended position and a retracted position. The plunger is connected to move the exhaust valve between the first and second positions respectively in response to movement of the actuator between the retracted and extended positions. A control valve has a spool movable between a first position and a second position. The control valve is connected to the actuator, the source of high pressure fluid flow, and the reservoir. The control valve is adapted to deliver fluid flow from the actuator to the reservoir at the first position of said spool and is adapted to deliver high pressure fluid flow from the source to the actuator at the second position of the spool and move said actuator from the retracted position to the extended position. An electronic control module is connected in control communication with the control valve and adapted to deliver a control signal to the control valve. The control valve spool is movable to the second position in response to receiving the control signal. The electronic control module automatically delivers the control signal to the control valve in response to a predetermined elapsed time during which the control valve is at the first position being greater than a predetermined time.

In another aspect of the present invention, a method of controlling a control valve associated with an internal combustion engine is provided. The control valve has a spool movable between a first position and a second position, a second port and a third port. The method includes the steps of monitoring an amount of elapsed time since the control valve spool was last moved; moving the control valve spool to the second position; and coupling the second port to the third port when the amount of elapsed time exceeds a predetermined time in order to discharge debris accumulated at the second port.

In yet another aspect of the present invention, a work machine, has an engine, an exhaust valve attached to the engine and operative to move between an open position and a closed position, a fluid operated actuator operatively connected to said exhaust valve and adapted to move the exhaust valve to the open position, a reservoir, a source of high pressure fluid source adapted to supply a high pressure action fluid and a control valve connected to the hydraulic control valve and movable between a first position operable to connect the actuator to a low pressure fluid source and a second position operable to connect the actuator to the source of high pressure fluid. An electronic control module connected in control communication with the control valve is adapted to generate a control signal to position the control valve in the second position when an elapsed time, during which the control valve is in the first position, is greater than a predetermined time.

DETAILED DESCRIPTION

An exemplary embodiment of the present invention provides a control system and method for shifting a spool of a fluid control valve to reduce silting in the fluid control valve. The following description uses a compression release brake of an internal combustion engine as an example only. This invention may be applied to other types of control systems for machines and other devices.

Figure 1:
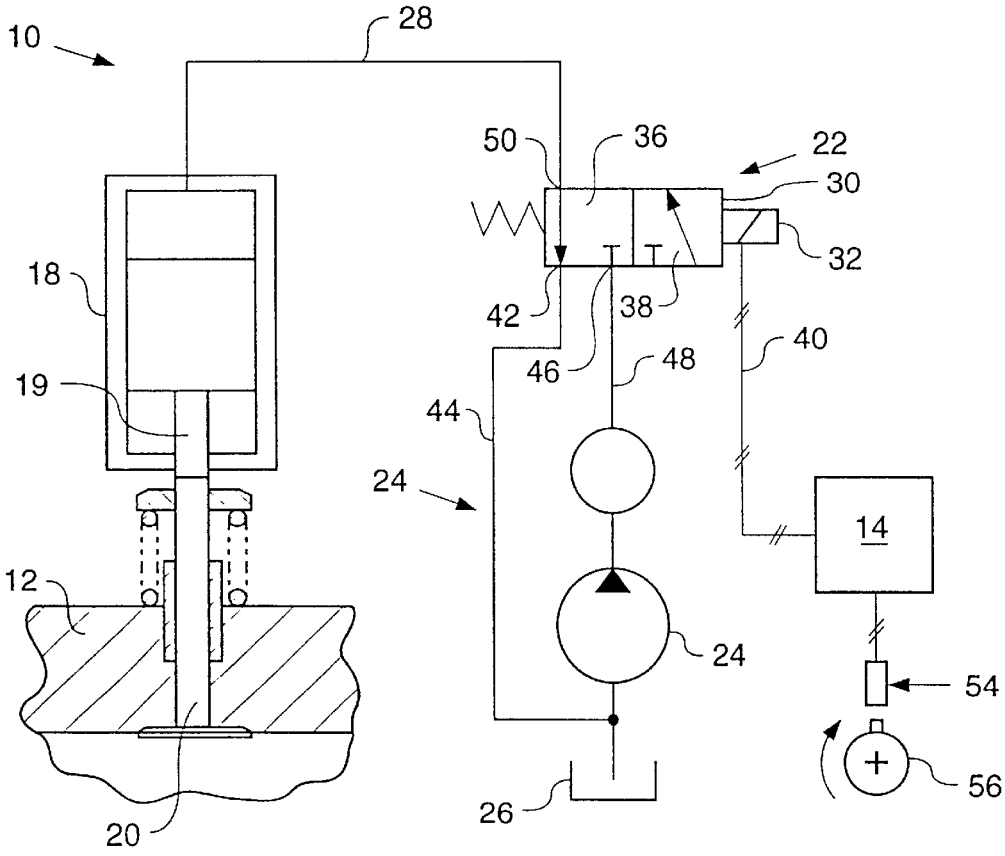
FIG. 1 is a schematic representation of an embodiment of a control system having an actuator operatively connected to an exhaust valve, a control valve for controlling the flow of high pressure fluid to the actuator and an electronic control module for controlling actuation of a control valve.

Referring to FIG. 1, a machine 10, for example an internal combustion engine 12 which sequentially and repetitively undergoes, intake, compression, expansion and exhaust cycles during operation is shown. The machine 10 can also mean a mobile machine, including but not limited to heavy off road equipment, over the road trucks, buses, or other machines, such as manufacturing machines. The engine 12 is controlled by an electronic control module 20 in a conventional manner. The engine 12 includes a plurality of cylinders 16 (only one partially shown). Each cylinder 16 includes at least one actuator 18 having a plunger 19 movable between retracted and extended positions for controlling the position of an exhaust valve 20 and thereby controlling fluid flow between the engine cylinder 16 and an exhaust manifold (not shown). In a preferred application of the present invention, the engine 12 is a diesel engine, and the actuator 18 is hydraulically operated. The actuator 18 shares a common actuation fluid, such as high pressure hydraulic fluid, with a hydraulically actuated fuel injection system (not shown) of the engine 12. Those skilled in the art will appreciate that the present invention could find potential application to any machine 10 having a fluid operated actuator 18 or an engine 12 having a fluid operated actuator for controlling an engine valve 20, including an actuator 18 for performing compression release engine valve actuation. In the illustrated embodiment, the actuator 18 is associated with and actuates an engine exhaust valve 20.

A compression release brake control system 21 includes a fluid control valve 22, a source 24 of high pressure fluid, and a reservoir (or sump) 26. The actuator 18 is connected in fluid communication with the fluid control valve 22, by fluid connection 28.

The fluid control valve 22 includes a control valve spool 30 that is operatively controlled by an electrical actuator 32, such as a solenoid or a piezo electric actuator, connected to the fluid control valve 22. The spool may be biased by a spring 34 to a first position 36 and movable in response to actuation of the electrical actuator 32 to a second position 38. The electrical actuator 32 is connected in control communication with the electronic control module 14 via a conductor 40. The electronic control module 14 may selectively generate a control signal, such as a pulse signal, which is sent to the electrical actuator 32 of the fluid control valve 22 so as to shift the spool from the first position 36 to the second position 38.

In an exemplary embodiment of the present invention, the fluid control valve 22 is a three way, two position spool valve, having a first port 42 connected to the fluid reservoir 26 by a fluid connection 44, a second port 46 connected to the high pressure actuation fluid source 24 by a fluid connection 48, and a third outlet port 50 is connected to the fluid actuator 18 via the actuation fluid line 28. The control valve spool 30 communicates fluid flow between first and third ports 42,50 and blocks the passing of fluid flow between the second and third ports 46,50 at the first position 36 of the control valve spool 30. The control valve spool 30 connects the second and third ports 46,50 in fluid communication with each other and blocks the passing of fluid flow between the first and third ports 42,50 at the second position 38 of the of the control valve spool 30. Thus, the fluid control valve 22 communicates fluid flow between the actuator 18 and the reservoir 26 and blocks fluid flow between the source 24 and the actuator 18 at the first position 36 and passes pressurized fluid flow from the source 24 of high pressure fluid to the actuator 18 and blocks the passing of fluid flow from the actuator 18 to the reservoir 26 at the second position 38.

The electrical actuator 32 is operable to position the control valve spool 30 in the first or second positions 36,38. When the electrical actuator 32 is not energized, the control valve spool 30 is positioned at the first position 36 and the actuator 18 is in communication with the reservoir 26 so that the exhaust valve 20 is maintained in a closed position by valve spring 52 thereby preventing fluid communication between the cylinder 16 and the exhaust manifold. When the electrical actuator 32 is energized by the electronic control module 14 via conductor 40, the control valve spool 30 is positioned at the second position 38 wherein the control valve spool 30 connects the actuator 18 to the high pressure actuation fluid source 24 via fluid connections 28,48. In response to a connection to high pressure actuation fluid source 24, the exhaust valve actuator 18 moves the exhaust valve member 20 to an open position so that air pressure may be released from the cylinder 16. In accordance with an exemplary embodiment of the present invention, the control signal causes the exhaust valve member 20 to move to the open position for approximately 0.2 to 0.4 milliseconds before returning to the closed position.

The electronic control module 14 is communicably linked to sense an engine parameter, for example, engine speed, crank angle, cylinder position, and cylinder pressure to mention a few. The sensor 54 delivers a sensed parameter signal to the electronic control module 14. Specifically, the sensed parameter enables the engine timing, e.g., piston position, to be monitored and determined. For example, in operation, the crank shaft 56 of the engine 12 rotates when the engine 12 is being operated. The rotation of the crankshaft results in the piston(s) of the engine 12 between a top dead center position and a bottom dead center position. In one embodiment, the sensor 54 may monitor the rotational position of the crankshaft 56 and send an associated signal to the electronic control module 14. A particular piston position may be determined by correlating a piston position with the sensed crank angle position. Therefore, by monitoring the crank angle position, the piston position may be determined. The sensor 54 may be a crankshaft sensor that is disposed adjacent to the crankshaft 56 and monitors the rotational position of the engine crankshaft and responsively produces a crankshaft pulse train. The sensor 54 may be of an optical or magnetic type.

In accordance with an exemplary embodiment of the present invention, the engine control module 14 is operable to periodically generate the control signal which is sent to the electrical actuator 32 of the fluid control valve 22 so as to position the control valve spool 30 at the second position. This movement allows the discharge or removal of debris accumulated at a valve clearance of the second inlet port 46 coupled to the high pressure actuation fluid source 24 without triggering a compression release braking event in the cylinder 16. In particular, the engine control module 14 includes an internal timer or counter (not shown) which is initialized or reset when the electronic control module 14 issues the control signal via the conductor 40 to the electrical actuator 32 of the fluid control valve 22 to position the control valve spool 30 at the second position. Those skilled in the art will appreciate that an external timer (not shown) may be utilized in place of the internal timer of the electronic control module 14, wherein the external timer is communicably linked to transmit a timing signal to the electronic control module 14 and the external timer is reset initialized by the electronic control module 14 when the electronic control module 14 issues the control signal via the conductor 40 to the electrical actuator 32 of the control valve 22. After the timer reaches a predetermined time, the electronic control module may generate the control signal which is sent to the electrical actuator 32 of the fluid control valve 22 when the electronic control module 14 determines that the cylinder 16 is in a predetermined state in which the opening of the exhaust valve 20 will not trigger a compression release braking event, i.e., the opening of the exhaust valve 20 would not cause a release of pressurized fluid from the cylinder 16. In particular, the electronic control module 14 determines, based on the signal from the sensor 54, whether the cylinder 16 is operating in the exhaust stroke at which air in the cylinder is in a low pressure state.

As discussed above, when the control valve spool 30 is positioned at the second position 38, the exhaust valve actuator 18 is connected to the high pressure actuation fluid source 24 via the fluid connection 28, thereby causing the exhaust valve actuator 18 to move the exhaust valve 20 to the open position. However, a compression release braking event is prevented from occurring when the exhaust valve 20 is opened due to the low pressure state of the fluid in the cylinder 16 during the exhaust stroke.

In accordance with the exemplary embodiment of the present invention, the electronic control module 14 may set the predetermined time to be approximately 1–2 minutes. Further, the electronic control module 14 may variably set the predetermined time based on an estimated level of debris in the high pressure actuation fluid. In particular, since the level of debris in the high pressure actuation fluid increases with engine operation time, the electronic control module 14 may decrease the predetermined time as a usage time of the high pressure actuation fluid increases. That is, the level of debris in the high pressure actuation fluid may be relatively low immediately after the high pressure actuation fluid is changed in the engine 12 and steadily increases over time as the engine 12 is operated. Accordingly, the electronic control module 14 may variably set the predetermined time as a function of a usage time of the high pressure actuation fluid since a last time the high pressure actuation fluid was changed.

Figure 2:
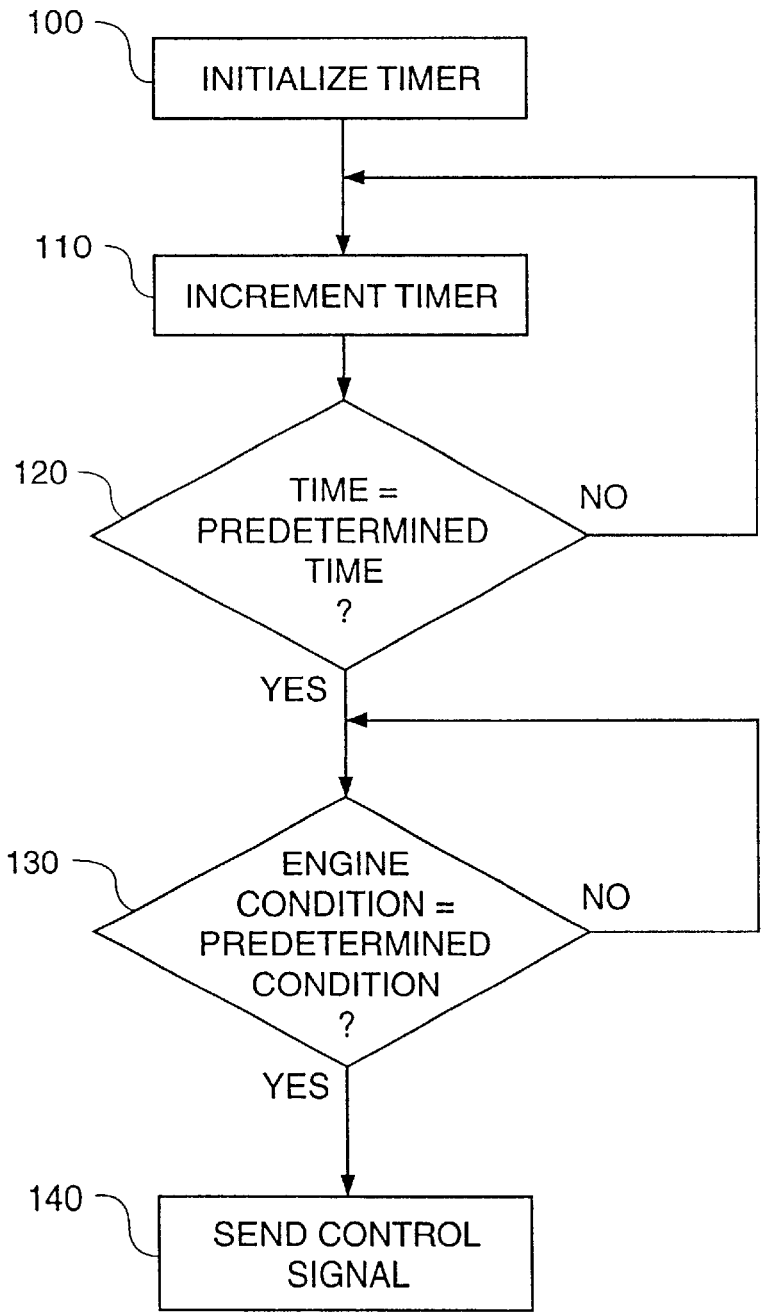
FIG. 2 is a flow diagram for the electronic control module of FIG. 1.

Referring to FIG. 2, a software flow diagram is illustrated that represents a exemplary software strategy for incorporation in to the electronic control module 14 according to the present invention. Operation of the fluid control valve 22 for reducing silting in the fluid control valve 22 according to an exemplary embodiment of the present invention will be described. In step 100, a count value of the internal timer of the electronic control module 14 is initialized or reset when the electronic control module issues a control signal via the conductor 40 to the electrical actuator 32 of the control valve 22 to place the control valve spool 30 in the second position 38. In step 110, the time value of the internal timer is incremented. In step 120, the electronic control module determines if the time value is equal to a predetermined time amount. If the time value is not equal to the predetermined time amount, the process returns to step 110. If the time value is equal to the predetermined time amount, the process proceeds to step 130, wherein it is determined whether the cylinder is in a predetermined state such that actuation of the exhaust valve 20 will not trigger a compression release braking event, i.e., the opening of the exhaust valve 20 would not cause a release of pressurized fluid from the cylinder 16. In accordance with an exemplary embodiment, the electronic control module 14 determines that the cylinder is operating in a predetermined state in which actuation of the exhaust valve 20 will not trigger a compression release braking event when the cylinder 16 is operating in the exhaust stroke so that the air in the cylinder is in a low pressure state. If the cylinder 16 is operating in the predetermined state, the engine control module 14 sends the control signal to the electrical actuator 32 in step 140. In response to the control signal from the electronic control module 14, the electrical actuator 32 is temporarily energized to cycle the control valve member 23 from the first position 36 to the second position 38 and then back to the first position 36 so that the control valve spool 30 temporarily connects the exhaust valve actuator 18 to the high pressure actuation fluid source 24. As a result, the exhaust valve actuator 18 moves the exhaust valve member 20 to the open position and then back to the closed position.

The shifting of the control valve spool 30 may serve to flush or remove debris accumulated from silting in the sealing clearance of the control valve spool 30. Further, a compression release braking event is prevented from occurring when the exhaust valve 20 is opened due to the low pressure state of the fluid in the cylinder during the exhaust stroke.

While aspects of the present invention have been particularly shown and described with reference to the preferred embodiment above, it will be understood by those skilled in the art that various additional embodiments may be contemplated without departing from the spirit and scope of the present invention. For example, the control system and method of the present invention may be applied to any control valve 22 coupled to a high pressure actuation fluid source in which silting may be a problem due to infrequent operation of the control valve, such a pneumatic controlled valves. Further, although the actuation fluid described in the exemplary embodiment the present invention is an engine lubricating oil, those skilled in the art will appreciate that the present invention could find potential application to other types of pressurized fluids including pressurized air. However, a device or method incorporating such an embodiment should be understood to fall within the scope of the present invention as determined based upon the claims below and any equivalents thereof.

Industrial Applicability

Fluid control valves 22 which are utilized in high pressure applications and operate only a small portion of the time may be subjected to silting. In particular, when a normally closed port 46 of a fluid control value 22 is coupled to a high pressure actuation fluid source 24, debris in the high pressure actuation fluid may accumulates and be compacted in the sealing clearance of the inlet port of the fluid control valve 22. As a result, the fluid control valve 22 may not perform correctly.

In the schematic diagram of the present invention illustrated in FIG. 1, the electronic control module 14 controls the hydraulic control valve 22 to position the control valve spool 30 in the second position 38 when the amount of time which the control valve spool 30 has been in the first position 36 is equal to the predetermined time and the cylinder 16 is in a predetermined state in which the opening of the exhaust valve 20 will not trigger a compression release braking event. As a result, debris accumulated around a valve clearance of the second port 46 of the control valve spool 30 may be discharged to reduce or prevent the effects of silting.

The method and apparatus of certain embodiments of the present invention, when compared with other methods and apparatus, may have the advantage of reducing or preventing silting in the fluid control valve 22 and being more economical to manufacture and use. Such advantages are particularly worthy of incorporating into the design, manufacture and operation of various work machines. In addition, the present invention may provide advantages that have not been discovered yet.

Other aspects, and advantages of the present invention can be obtained from a study of the drawings, the disclosure and the appended claims.

What is claimed is:

1. A control system, comprising:

an actuator having a plunger movable between an extended position and a retracted position;

a source of high pressure fluid flow;

a fluid reservoir;

a control valve having a spool movable between a first position and a second position, said control valve being connected to said actuator, said source of high pressure fluid flow, and said reservoir, said control valve being adapted to deliver fluid flow from said actuator to said reservoir at the first position of said spool and being adapted to deliver high pressure fluid flow from said source to said actuator at the second position of said spool; and an electronic control module connected in control communication with the control valve and being adapted to deliver a control signal to said control valve, said control valve spool being movable to a one of said first and second positions in response to receiving said control signal, said electronic control module automatically delivering said control signal to the control valve in response to an occurrence of a predetermined elapsed time based on an at least one engine parameter related to a silting of the control valve and a previous time of delivery of a control signal to said control valve.

2. The control system, as set forth in claim 1, wherein said control valve being movable from said first position to the second position in response to receiving said control signal.

3. The control system, as set forth in claim 2, including:

a sensor connected to said electronic control module and being adapted to sense a parameter and deliver a responsive parameter signal;

said electronic control module receiving said parameter signal, determining if said parameter signal is indicating that actuation of the control valve is permissible, and delivering a responsive signal to cause said control valve spool to move to the second position in response to the predetermined elapsed time of the control valve at the first position being greater than the predetermined elapsed time.

4. The control system, as set forth in claim 2, wherein the electronic control module is further adapted to set the predetermined elapsed time based on a usage time of the high pressure actuation fluid.

5. A control system, comprising:

an actuator having a plunger movable between an extended position and a retracted position;

a source of high pressure fluid flow;

a fluid reservoir;

a control valve having a spool movable between a first position and a second position, said control valve and being connected to said actuator, said source of high pressure fluid flow, and said reservoir, said control valve being adapted to deliver fluid flow from said actuator to said reservoir at the first position of said spool and being adapted to deliver high pressure fluid flow from said source to said actuator at the second position of said spool;

an electronic control module connected in control communication with the control valve and being adapted to deliver a control signal to said control valve, said control valve spool being movable to a one of said first and second positions in response to receiving said control signal, said electronic control module automatically delivering said control signal to the control valve in response to a predetermined elapsed time during which the control valve is at said one of the first and second positions being greater than a predetermined time; said control valve being movable to the second position in response to receiving said control signal, and said electronic control module automatically delivering said control signal in response to a predetermined elapsed time during which the control valve being at said first position being greater than a predetermined time; and said electronic control module being adapted to set the predetermined time based on an estimated level of debris in the high pressure actuation fluid.

* * * * *